US006200165B1

(12) United States Patent
Simmel

(10) Patent No.: US 6,200,165 B1
(45) Date of Patent: Mar. 13, 2001

(54) SHIELDED ELECTRICAL CONNECTOR WITH A FOLDED WALL

(75) Inventor: George M. Simmel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/409,636

(22) Filed: Oct. 1, 1999

(51) Int. Cl.[7] ..... H01R 13/648
(52) U.S. Cl. ..... 439/609; 439/607
(58) Field of Search ..... 439/607–610, 439/108, 676

(56) References Cited

U.S. PATENT DOCUMENTS

| | | | |
|---|---|---|---|
| 4,653,836 | 3/1987 | Peele | 339/143 |
| 4,688,868 | 8/1987 | Noyes | 439/108 |
| 5,178,562 | 1/1993 | Ermini | 439/609 |
| 5,295,867 | 3/1994 | Bethurum | 439/607 |
| 5,496,183 | 3/1996 | Soes et al. | 439/79 |
| 5,508,889 | 4/1996 | Ii | 361/816 |
| 5,622,523 | 4/1997 | Kan et al. | 439/607 |
| 5,702,271 * | 12/1997 | Steinmann | 439/607 |
| 5,738,544 * | 4/1998 | Davis | 439/607 |
| 5,755,595 | 5/1998 | Davis et al. | 439/607 |
| 5,913,698 * | 6/1999 | Keng | 439/609 |
| 5,934,940 * | 10/1999 | Maranto et al. | 439/607 |
| 6,036,544 * | 3/2000 | Brunker et al. | 439/609 |

* cited by examiner

*Primary Examiner*—Hien Vu
(74) *Attorney, Agent, or Firm*—Stephen Z. Weiss

(57) ABSTRACT

An electromagnetic shield is provided for at least one electronic component. The shield includes an electrically conductive enclosure having walls defining an open end at a mating face of the component. A flexible elongated ground arm is integrally formed from the walls and extends generally parallel to the mating face. The ground arm includes a contact portion for engaging a conductive ground portion of a complementary mating electronic component. A portion of the walls is folded over in an area in registry with the ground arm to minimize electromagnetic leakage about the ground arm.

13 Claims, 5 Drawing Sheets

SHIELDED ELECTRICAL CONNECTOR WITH A FOLDED WALL

FIELD OF THE INVENTION

This invention generally relates to the art of electrical connectors and, particularly, to a shielded electrical connector having a new and improved electromagnetic shield.

BACKGROUND OF THE INVENTION

A wide variety of electrical connectors require protection against the egress or ingress of radio frequency interference (RFI) and/or electromagnetic interference (EMI). This is particularly true in electrical connectors used with high speed electronic equipment. "EMI" has become fairly generic to describe most types of interference caused by electronic waves.

EMI protection typically is provided by substantially enclosing a connector, at least about its mating interface, with an electrically conductive shield. Such shielding enclosures typically are stamped and formed from sheet metal material. The shields are grounded, such as to a ground wire of an electrical cable or to a ground circuit trace on a printed circuit board. When two connectors are mated, it is desirable to have the shields of the two connectors in positive engagement to establish a common ground therethrough and to prevent electromagnetic radiation from or to the connectors in the area of the mating interface thereof.

Heretofore, EMI protection at the interface of a pair of mating connectors has been accomplished simply by overlapping the two shields of the respective connectors. Although this method is quite effective, it requires additional space in the mating direction of the connectors and this is highly undesirable when space is critical in miniaturized, high speed electronics. The same type of space problem arises when radially extending flaps are used between the shields to establish positive engagement, with the space problem being in the transverse direction rather than the mating direction.

In order to solve the space problems described above, positive engagement between a pair of shields of a pair of mating connectors has been accomplished by using flexible, cantilevered ground arms which are stamped directly out of a side wall of at least one of the shields at the mating interface of the connectors. Although such flexible ground arms do not require additional space, they create further problems in creating stamped openings about the arms through which electromagnetic interference can pass. In addition, if the flexible arms are too short, they are susceptible to failure due to stress and strain from numerous mating and unmating cycles of the connectors. In other words, it is desirable to have relatively long cantilevered ground arms, but the size of connectors often do not allow sufficient dimensions to lengthen the arms. The present invention is directed to solving one or more of this myriad of problems in shielded electrical connectors.

SUMMARY OF THE INVENTION

An object, therefore, of the invention is to provide a new and improved electromagnetic shield for at least one electronic component.

Another object of the invention is to provide an electrical connector with a new and improved electrically conductive shield.

In the exemplary embodiment of the invention, the electromagnetic shield includes an electrically conductive enclosure having wall means defining an open end at a mating face of the component. A flexible elongated ground arm is integrally formed from the wall means and extends generally parallel to the mating face. The ground arm includes a contact portion for engaging a conductive ground portion of a complementary mating electronic component. A portion of the ground means is folded over in an area in registry with said ground arm to minimize electromagnetic leakage about the ground arm.

As disclosed herein, the enclosure is stamped and formed of conductive sheet metal material. The ground arm is stamped from the wall means leaving an opening about the ground arm. The folded over portion of the wall means is in registry with at least a portion of the opening. The ground arm is cantilevered and extends across a substantial portion of the mating face. The contact portion is at a distal end of the cantilevered ground arm.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
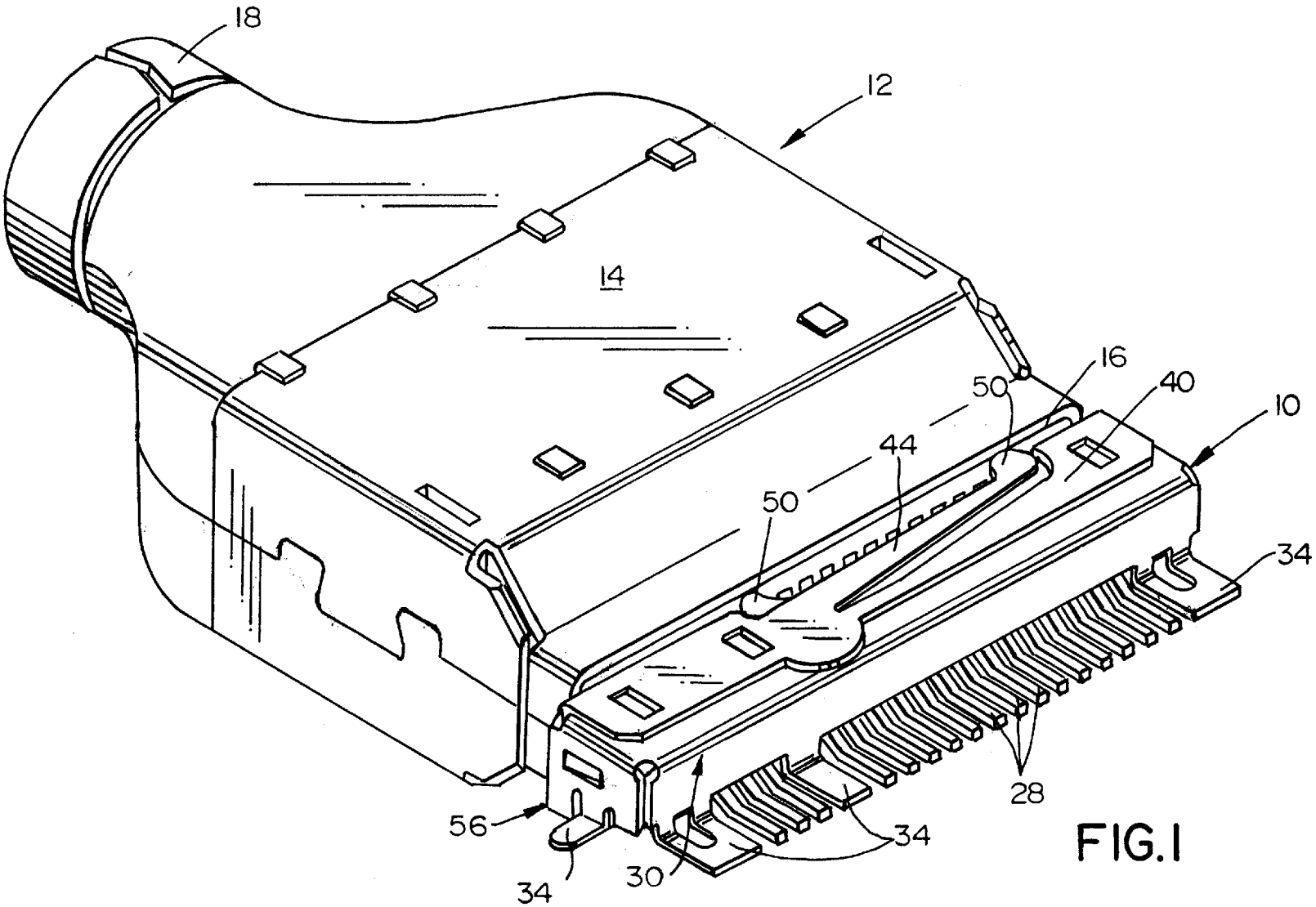
FIG. 1 is a top perspective view of a pair of mating connectors, with one of the connectors embodying the concepts of the invention.

Referring to the drawings in greater detail, and first to FIG. 1, the invention is embodied in an electrical connector, generally designated 10, which is adapted for mounting on a surface of a printed circuit board and which mates with a plug connector, generally designated 12, which is adapted for terminating an electrical cable. In other words, board-mounted connector 10 is a receptacle connector for receiving plug connector 12.

Plug connector 12 is substantially surrounded by a shield of electrically conductive sheet metal material. The shield has a front face 16 which is engageable by a plurality of ground arms of connector 10, as will be described in greater detail hereinafter. The shield has a rear end 18 which is crimped onto an electrical cable. Actually, rear end 18 is crimped onto the ground foil of the cable to perform a dual function of providing strain relief on the cable as well as grounding shield 14 to the foil.

Figure 2:
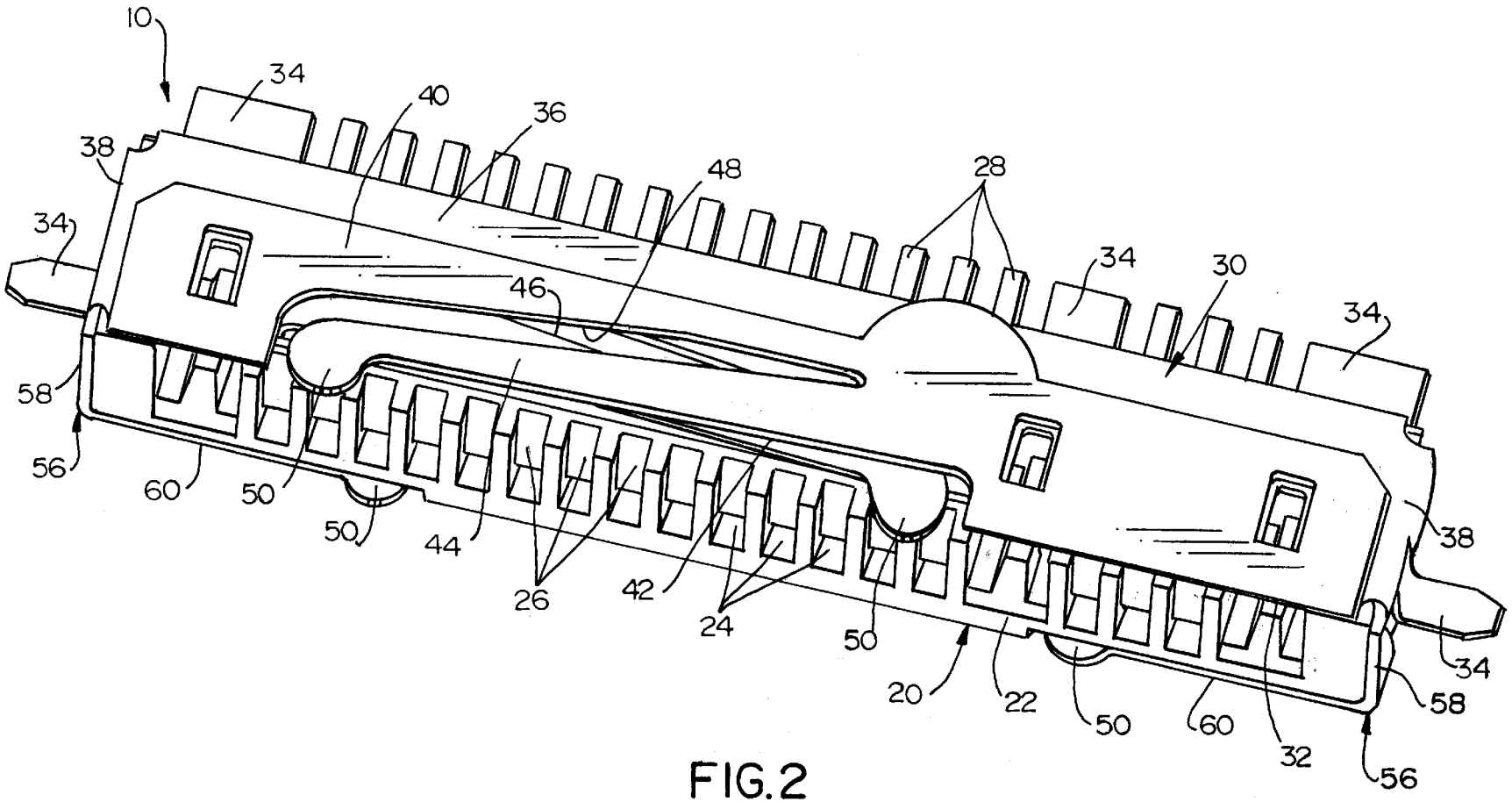
FIG. 2 is an enlarged top perspective view looking at the mating face of the one connector.

Referring to FIG. 2 in conjunction with FIG. 1, board-mounted connector 10 includes a dielectric housing, generally designated 20, which defines a mating face 22 of the connector. The housing may be a one-piece stricture unitarily molded of dielectric material such as plastic or the like. The housing has a plurality of through passages 24 which mount a plurality of terminals 26 which have solder tails 28 projecting from a rear of the housing for a solder connection to appropriate signal and power circuit traces on the printed circuit board.

The invention is incorporated in an electrically conductive shield, generally designated 30, which forms an electrically conductive enclosure substantially about housing 20, leaving an open end 32 at mating face 20 of the connector. The shield is stamped and formed of conductive sheet metal material and includes a plurality of tail portions 34 for solder connection to appropriate ground traces on the printed circuit board.

As seen best in FIG. 2, stamped and formed sheet metal shield 30 includes wall means defined by a top wall 36 which forms the major top side of the shield. The top wall is joined perpendicularly to a pair of end walls 38 which form minor ends of the shield. A flap 40 is folded over the top of top wall 36. A flexible elongated ground arm 42 is stamped out of top wall 36 so the ground arm is integral with and cantilevered from the top wall. A second flexible elongated ground arm 44 is stamped out of flap 40 to be integral therewith and cantilevered therefrom. When the ground arms are stamped, an opening 46 is formed behind ground arm 42, and an opening 48 is formed behind ground arm 44. By criss-crossing the arms as seen in FIG. 2, each arm closes a good portion of the opening behind the other arm to minimize the escape of electromagnetic interference therethrough and provides an additional pathway for high frequency currents through capacitative coupling. Each flexible ground arm 42 and 44 has a rounded contact portion 50 at the distal end thereof for resiliently engaging front face 16 of shield 14 of plug connector 12 as seen clearly in FIG. 1. Therefore, upon mating of connectors 10 and 12, flexible cantilevered ground arms 42 and 44 become spring loaded to establish good grounding connections between shields 30 and 14 of connectors 10 and 12, respectively.

It should be understood that the use of two overlapping ground arms 42 and 44 is a preferred embodiment of the invention. However, by folding flap 40 over top wall 36, only one ground arm could be stamped out of either the flap or the top wall, with the other of the flap or top wall completely blocking any opening formed behind the single ground arm and through which electromagnetic interference could pass.

Figure 3:
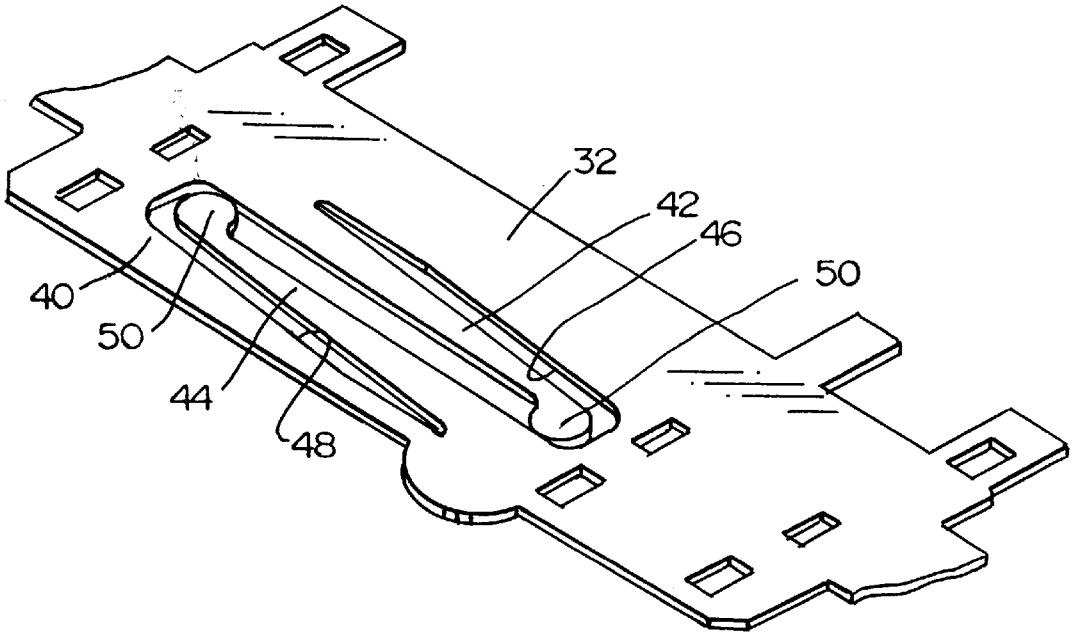
FIG. 3 is a fragmented perspective view of a blank of sheet metal material partially stamped to form two ground arms.
Figure 4:
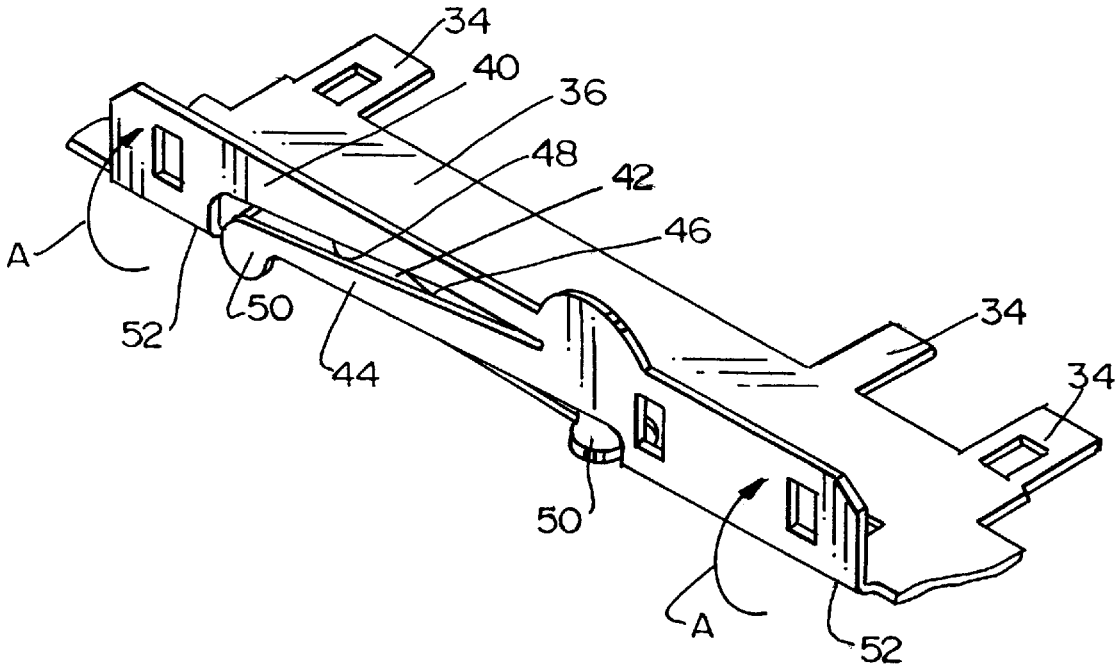
FIG. 4 is a view of the blank of FIG. 3 in the process of being folded.

FIGS. 3 and 4 simply show a portion of the stamping and forming process for ground arms 42 and 44 and folding flap 40 over top wall 36 of shield 30. In particularly, FIG. 3 shows ground arm 42 having been stamped out of top wall 36 leaving opening 46 therebehind. Ground arm 44 is seen stamped out of what will become flap 40, leaving opening 48 therebehind. FIG. 4 shows flap 40 being folded at 52 in the direction of arrow "A" whereupon the flap eventually will be folded onto top wall 36 as seen in FIG. 2. Of course, if only one ground arm 42 or 44 is stamped out of top wall 36 or flap 40, the other of the top wall or flap will substantially entirely close the opening about the single ground arm to completely eliminate or at least minimize electromagnetic leakage about the ground arm.

Figure 5:
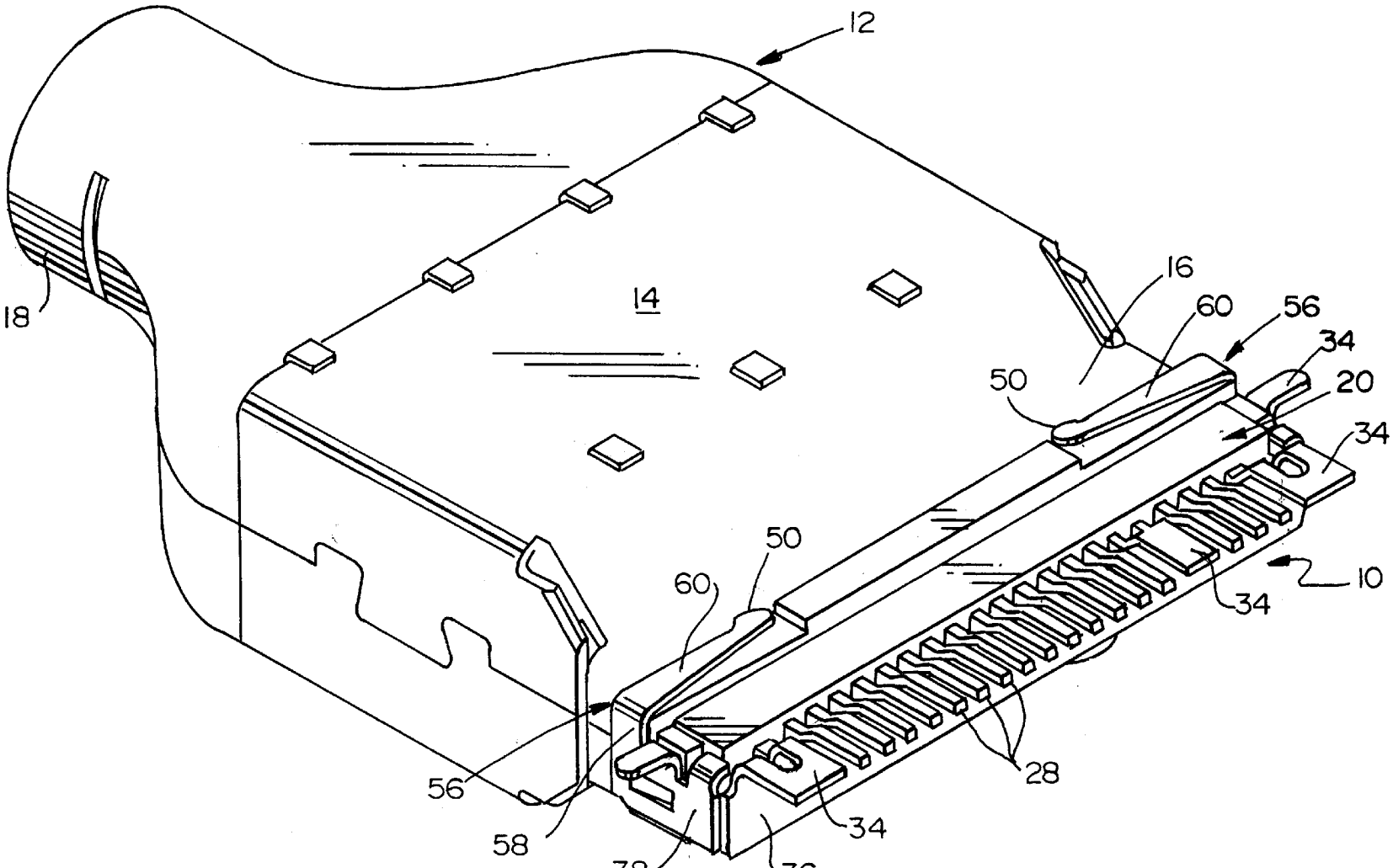
FIG. 5 is a bottom perspective view of the mating connectors of FIG. 1.
Figure 6:
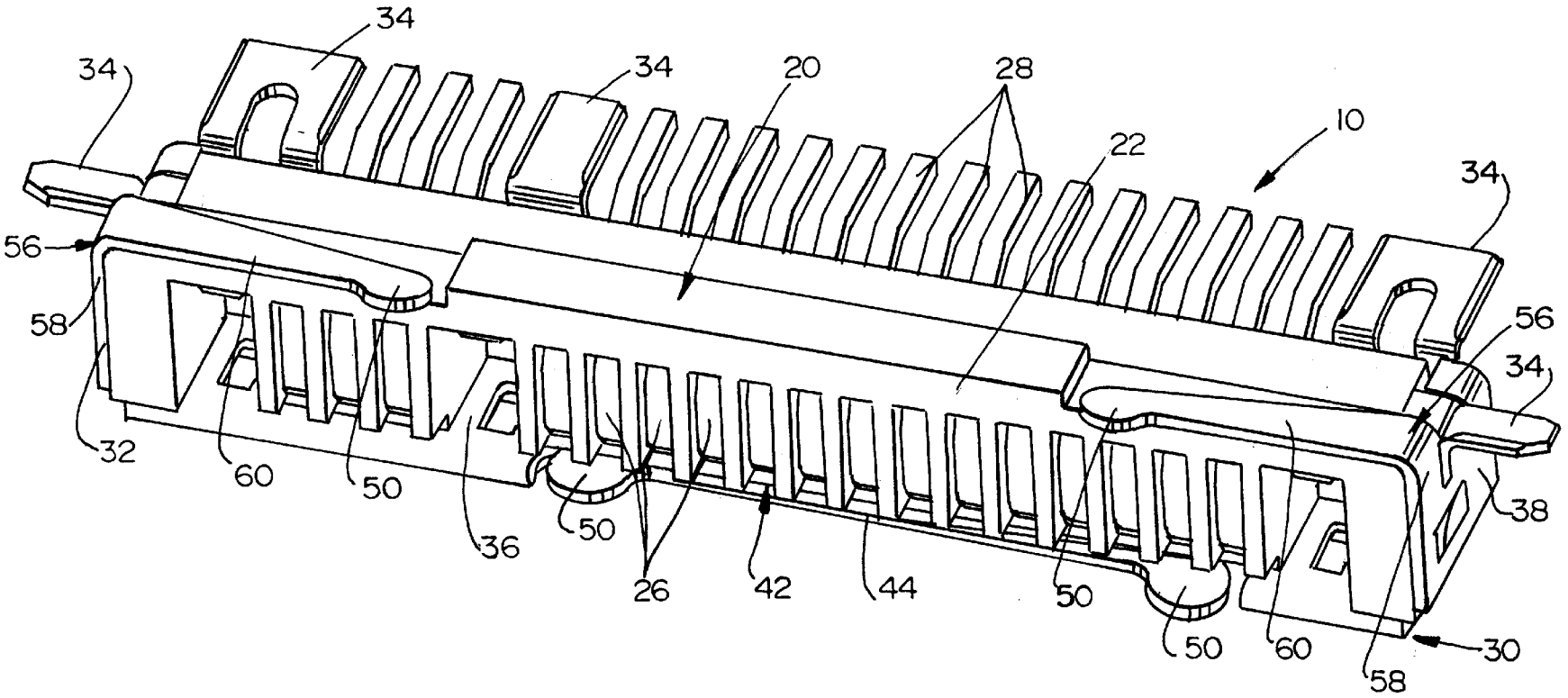
FIG. 6 is a perspective view similar to that of FIG. 5, but looking at the bottom of the one connector.

FIGS. 5 and 6 show the bottom of board-mounted connector 10 and a second pair of ground arms, generally designated 56, having contact portions 50 for engaging front face 16 of shield 14 of plug connector 12. Ground arms 56 are effective in connectors where it is found undesirable or impossible to provide a sufficiently long ground arm out of a single wall or side of the connector. In other words, it can be seen most clearly in FIG. 6 that each ground arm 56 has a right-angular configuration. Each arm 56 has a first portion 58 contiguous with one of the end walls 38 of shield 30. Each arm is bent to form a second portion 60 which extends at a right angle to portion 58 and across the bottom side of the housing 20. Although board-mounted connector 10 does not have a bottom wall, effective shielding is achieved by using two ground arms 56. The two ground arms 56 represent multiple contacts which provide a lower impedance between the printed circuit board and the cable attached to the plug connector 12, a more balanced current flow through the shield and a balanced mechanical force completely around the contact edge of the shield. When the ground arms 56 are combined with the copper grounding plate at the bottom of the printed circuit board, adequate electromechanical leakage is substantially reduced.

The advantages of providing right-angled ground arms 56 are not limited to board-mounted connectors. The right-angled ground arms could be placed at the top wall of the shield, or on a plug shield at the intersection of any transverse walls of any shield or on a plug shield. The advantages are provided by forming a single ground arm out of two adjacent walls of a given shield, so that the ground arm can be lengthened beyond that which a single wall may possibly afford. In addition, the twisting action of portion 60 of ground arm 56 relative to portion 58 enhances the resiliency of the ground arm.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electromagnetic shield for at least one electronic component, comprising:

an electrically conductive enclosure, stamped and formed of conductive sheet metal material, having a top wall and two end walls defining an open end at a mating face of the component;

a flexible elongated ground arm integrally formed from said top wall with an opening remaining about the ground arm, and moving in a direction perpendicular to said mating face in a plane parallel to the top wall, the ground arm including a contact portion for engaging a conductive ground portion of a complementary mating electronic component; and a portion of said top wall being folded over in an area overlying at least a portion of said opening about said ground arm to minimize electromagnetic leakage about the ground arm.

2. The electromagnetic shield of claim 1 wherein said ground arm is cantilevered and extends across a substantial portion of said mating face.

3. The electromagnetic shield of claim 2 wherein said contact portion is at a distal end of the ground arm.

4. The electromagnetic shield of claim 1, including a second ground arm formed from the folded over portion.

5. The electromagnetic shield of claim 4 wherein said two ground arms crisscross each other.

6. An electromagnetic shield for at least one electronic component, comprising:

an electrically conductive enclosure stamped and formed of sheet metal material and having a top wall and two end walls defining an open end at a mating face of the component;

a flexible elongated ground arm stamped from said top wall leaving an opening about the ground arm, the ground arm moving in a direction perpendicular to said mating face in a plane parallel to the top wall and extending across a substantial portion of the top wall at said mating face, and the ground arm including a contact portion for engaging a conductive ground portion of a complementary mating electronic component; and a portion of said wall means being folded over and overlying at least a portion of said opening to minimize electromagnetic leakage about the ground arm.

7. The electromagnetic shield of claim 6 wherein said contact portion is at a distal end of the ground arm.

8. An electrical connector, comprising:

a dielectric housing defining a mating face of the connector;

a plurality of terminals mounted on the housing;

an electrically conductive shield about at least a portion of the dielectric housing, said shield stamped and formed of conductive sheet metal material and having a top wall and two end walls defining an open end about said mating face;

a flexible elongated ground arm integrally formed from said top wall and moveable in a direction perpendicular to said mating face in a plane parallel to the top wall, the ground arm including a contact portion for engaging a conductive ground portion of a complementary mating connector; and a portion of said top wall being folded over and overlying said ground arm to minimize electromagnetic leakage about the ground arm.

9. The electrical connector of claim 8 wherein said ground arm is stamped from said top wall leaving an opening about the ground arm, and said folded over portion of the top wall overlying at least a portion of said opening.

10. The electrical connector of claim 8 wherein said ground arm is cantilevered and extends across a substantial portion of the open end about said mating face.

11. The electrical connector of claim 10 wherein said contact portion is at a distal end of the ground arm.

12. The electromagnetic shield of claim 8, including a second ground arm formed from the folded over portion.

13. The electromagnetic shield of claim 12 wherein said two ground arms criss-cross each other.

* * * * *